US010634412B2

(12) United States Patent
Boehringer et al.

(10) Patent No.: US 10,634,412 B2
(45) Date of Patent: Apr. 28, 2020

(54) CONCEALED UPSTREAM AIR TOWER GUIDE VANES

(71) Applicant: WHIRLPOOL CORPORATION, Benton Harbor, MI (US)

(72) Inventors: Bruno Boehringer, Benton Harbor, MI (US); Darci Cavali, St. Joseph, MI (US); Benjamin G. Jimenez, Burns Harbor, IN (US); Mahalingappa Mulimani, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 83 days.

(21) Appl. No.: 15/899,710

(22) Filed: Feb. 20, 2018

(65) Prior Publication Data

US 2018/0292120 A1 Oct. 11, 2018

Related U.S. Application Data

(60) Provisional application No. 62/483,738, filed on Apr. 10, 2017.

(51) Int. Cl.
*F25D 17/04* (2006.01)
*F25D 17/08* (2006.01)
(Continued)

(52) U.S. Cl.
CPC ..... *F25D 17/065* (2013.01); *F25D 11/02* (2013.01); *F25D 17/045* (2013.01);
(Continued)

(58) Field of Classification Search
CPC ..... F25D 2317/06; F25D 2317/063; F25D 2317/066; F25D 2317/067;
(Continued)

(56) References Cited

U.S. PATENT DOCUMENTS 2,667,185 A * 1/1954 Beavers ..... F24F 13/081 138/37
2,934,023 A 4/1960 Lamkin et al.
(Continued)

FOREIGN PATENT DOCUMENTS

CH 707892 10/2014
CN 202630562 12/2012
(Continued)

*Primary Examiner* — Frantz F Jules
*Assistant Examiner* — Erik Mendoza-Wilkenfel
(74) *Attorney, Agent, or Firm* — Price Heneveld LLP

(57) ABSTRACT

A refrigerating appliance includes an evaporator for providing cooled air to a refrigerating compartment. An air tower defines an air channel for directing the cooled air from the evaporator to the refrigerating compartment. A plurality of air-directing guide vanes is positioned within the air tower and proximate a top of the air channel. The air directing guide vanes direct the cooled air from the air channel to define redirected air that is delivered in a direction toward an upper cool-air slot defined within the air tower. The redirected air from the air-directing guide vanes travels through the upper cool-air slot at substantially the same velocity as the cooled air entering the air-directing guide vanes. The redirected air is directed through the upper cool-air slot and toward at least one upper corner of the refrigerating compartment.

16 Claims, 13 Drawing Sheets
(3 of 13 Drawing Sheet(s) Filed in Color)

(51) Int. Cl.
*F25D 17/06* (2006.01)
*F28F 25/12* (2006.01)
*F25D 11/02* (2006.01)

(52) U.S. Cl.
CPC ..... *F25D 17/067* (2013.01); *F25D 2317/063* (2013.01); *F25D 2317/0651* (2013.01); *F25D 2317/0665* (2013.01); *F25D 2317/0672* (2013.01); *F25D 2317/0681* (2013.01)

(58) Field of Classification Search
CPC ..... F25D 2317/0671; F25D 2317/0672; F25D 17/045; F25D 17/08; F25D 17/062; B60H 1/00564; B60H 1/26; F28F 25/12
See application file for complete search history.

(56) References Cited

U.S. PATENT DOCUMENTS

| | | | | |
|---|---|---|---|---|
| 3,129,711 | A | | 4/1964 | Schmitt-Matzen |
| 3,359,907 | A | | 12/1967 | Bochan |
| 3,375,677 | A | * | 4/1968 | Bright ..... F25D 17/065 62/89 |
| 3,455,119 | A | | 7/1969 | Bright |
| 3,653,807 | A | | 4/1972 | Platt |
| 3,680,893 | A | | 8/1972 | Giraud |
| 3,745,786 | A | * | 7/1973 | Laughlin ..... F25D 17/065 62/419 |
| 3,751,179 | A | | 8/1973 | Wassmann |
| 3,773,432 | A | | 11/1973 | Chow et al. |
| 3,836,001 | A | | 9/1974 | Heldreth |
| 3,896,641 | A | | 7/1975 | Worst |
| 3,953,146 | A | | 4/1976 | Sowards |
| 3,975,931 | A | | 8/1976 | Bischkopf |
| 4,068,870 | A | | 1/1978 | Whitney et al. |
| 4,251,758 | A | | 2/1981 | Pedersen et al. |
| 4,409,532 | A | | 10/1983 | Hollenbeck et al. |
| 4,451,069 | A | | 5/1984 | Melone |
| 4,600,361 | A | | 7/1986 | Bianco |
| 4,647,082 | A | | 3/1987 | Fournier et al. |
| 4,671,540 | A | | 6/1987 | Medvick et al. |
| 4,804,213 | A | | 2/1989 | Guest |
| 5,142,214 | A | | 8/1992 | Purson et al. |
| 5,214,936 | A | | 6/1993 | Lim et al. |
| 5,285,664 | A | | 2/1994 | Chang et al. |
| 5,395,140 | A | | 3/1995 | Wiethorn |
| 5,628,531 | A | | 5/1997 | Rosenberg et al. |
| 5,658,020 | A | | 8/1997 | Carman et al. |
| 5,740,835 | A | | 4/1998 | Murphy |
| 5,911,750 | A | | 6/1999 | Mandel et al. |
| 5,921,104 | A | | 7/1999 | Chang |
| 6,070,419 | A | | 6/2000 | Chang |
| 6,114,827 | A | | 9/2000 | Alvaro |
| 6,159,962 | A | | 12/2000 | Steiner et al. |
| 6,519,962 | B1 | | 2/2003 | Schuetter |
| 6,574,979 | B2 | | 6/2003 | Faqih |
| 6,574,984 | B1 | | 6/2003 | McCrea et al. |
| 6,672,628 | B2 | | 1/2004 | Thomas et al. |
| 6,854,772 | B2 | | 2/2005 | Weller et al. |
| 6,863,314 | B2 | | 3/2005 | Guest |
| 6,913,294 | B2 | | 7/2005 | Treverton et al. |
| 7,316,428 | B2 | | 1/2008 | Takayanagi et al. |
| 7,458,171 | B1 | | 12/2008 | Lentz |
| 7,510,216 | B2 | | 3/2009 | Tomerlin et al. |
| 7,624,896 | B2 | | 12/2009 | Doglioni Majer |
| 7,707,860 | B2 | | 5/2010 | Hong et al. |
| 7,770,418 | B2 | | 8/2010 | Kramme et al. |
| 7,866,182 | B2 | | 1/2011 | Lim et al. |
| 8,029,024 | B2 | | 10/2011 | Guest |
| 8,083,104 | B2 | | 12/2011 | Roetker et al. |
| 8,171,757 | B2 | | 5/2012 | Dahlke |
| 8,266,814 | B2 | | 9/2012 | Grunert |
| 8,499,978 | B2 | | 8/2013 | Dalchau et al. |
| 8,540,118 | B2 | | 9/2013 | McDonald et al. |
| 8,656,731 | B2 | | 2/2014 | Kim |
| 8,695,371 | B2 | | 4/2014 | Boarman et al. |
| 8,789,854 | B2 | | 7/2014 | Christian, Jr. et al. |
| 8,926,275 | B2 | | 1/2015 | Badafem et al. |
| 8,991,220 | B2 | | 3/2015 | Buso et al. |
| 9,010,144 | B2 | | 4/2015 | Park et al. |
| 9,065,363 | B2 | | 6/2015 | Marioni |
| 9,088,236 | B2 | | 7/2015 | Marioni |
| 9,255,358 | B2 | | 2/2016 | Kim |
| 9,273,903 | B2 | | 3/2016 | Vian et al. |
| 9,309,103 | B2 | | 4/2016 | Ergican et al. |
| 9,373,210 | B2 | | 6/2016 | Wittern, Jr. et al. |
| 9,404,211 | B2 | | 8/2016 | Hill et al. |
| 9,506,682 | B2 | | 11/2016 | Yun et al. |
| 9,581,377 | B2 | | 2/2017 | Kim et al. |
| 9,617,680 | B2 | | 4/2017 | Kitayama et al. |
| 9,644,308 | B2 | | 5/2017 | Leibman et al. |
| 9,702,078 | B2 | | 7/2017 | Lee |
| 9,702,080 | B2 | | 7/2017 | Lee et al. |
| 9,809,922 | B2 | | 11/2017 | Salomonsson |
| 9,890,029 | B2 | | 2/2018 | Comsa et al. |
| 9,903,064 | B2 | | 2/2018 | Del Pos et al. |
| 9,915,468 | B2 | | 3/2018 | You et al. |
| 2006/0277690 | A1 | | 12/2006 | Pyo et al. |
| 2010/0253075 | A1 | | 10/2010 | Werth |
| 2012/0032629 | A1 | | 2/2012 | Peterson et al. |
| 2012/0104021 | A1 | | 5/2012 | Cur et al. |
| 2012/0114473 | A1 | | 5/2012 | Badafem et al. |
| 2012/0228871 | A1 | | 9/2012 | Li |
| 2012/0246960 | A1 | | 10/2012 | Lee et al. |
| 2013/0257043 | A1 | | 10/2013 | Guest |
| 2013/0318813 | A1 | | 12/2013 | Hong et al. |
| 2014/0013616 | A1 | | 1/2014 | Lee et al. |
| 2014/0283542 | A1 | | 9/2014 | Jang |
| 2015/0197417 | A1 | | 7/2015 | Stagg et al. |
| 2015/0225226 | A1 | | 8/2015 | You et al. |
| 2015/0345072 | A1 | | 12/2015 | Ko et al. |
| 2016/0010271 | A1 | | 1/2016 | Shin et al. |
| 2016/0083238 | A1 | | 3/2016 | Koo |
| 2016/0083894 | A1 | | 3/2016 | Bison et al. |
| 2016/0090681 | A1 | | 3/2016 | Nash et al. |
| 2016/0115643 | A1 | | 4/2016 | Bison et al. |
| 2016/0138209 | A1 | | 5/2016 | Kitayama |
| 2016/0138849 | A1 | | 5/2016 | Lee et al. |
| 2016/0201985 | A1 | | 7/2016 | Lee et al. |
| 2016/0205988 | A1 | | 7/2016 | Bird et al. |
| 2016/0341462 | A1 | | 11/2016 | Kim |
| 2017/0037560 | A1 | | 2/2017 | Shin et al. |
| 2017/0051449 | A1 | | 2/2017 | Nam et al. |
| 2017/0059224 | A1 | | 3/2017 | Bae et al. |
| 2017/0298563 | A1 | | 10/2017 | Roetker et al. |
| 2017/0341920 | A1 | | 11/2017 | Gonzales |

FOREIGN PATENT DOCUMENTS

| | | | |
|---|---|---|---|
| DE | 2005011732 | | 7/2006 |
| EP | 0454640 | | 10/1991 |
| EP | 0682404 | | 11/1995 |
| EP | 945973 | | 9/1999 |
| EP | 2329757 | | 6/2011 |
| EP | 2508668 | A1 | 10/2012 |
| EP | 2620541 | | 7/2013 |
| GB | 2288457 | A | 10/1995 |
| JP | S57155777 | | 9/1982 |
| JP | 2006177330 | | 7/2006 |
| JP | 2008259665 | | 10/2008 |
| JP | 2009287527 | | 12/2009 |
| KR | 1020110125570 | | 11/2011 |
| KR | 101588137 | | 1/2016 |
| WO | 0346451 | | 6/2003 |
| WO | 2004045351 | | 6/2004 |
| WO | 20120226555 | | 2/2012 |
| WO | 2012072477 | | 6/2012 |
| WO | 2012146534 | A2 | 11/2012 |
| WO | 2014115976 | | 7/2014 |
| WO | 2015010731 | | 1/2015 |
| WO | 2016204414 | | 12/2016 |
| WO | 2017023122 | | 2/2017 |

* cited by examiner

CONCEALED UPSTREAM AIR TOWER GUIDE VANES

CROSS-REFERENCE TO RELATED APPLICATION

This application claims priority to and the benefit under 35 U.S.C. § 119(e) of U.S. Provisional Patent Application No. 62/483,738, filed on Apr. 10, 2017, entitled "CONCEALED UPSTREAM AIR TOWER GUIDE VANES," the entire disclosure of which is hereby incorporated herein by reference.

FIELD OF THE DEVICE

The device is in the field of refrigerating appliances, and more specifically, guide vanes that are disposed and concealed within an air tower for delivering cool air to a compartment of the appliance.

SUMMARY

In at least one aspect, a refrigerating appliance includes an evaporator for providing cooled air to a refrigerating compartment. An air tower defines an air channel for directing the cooled air from the evaporator to the refrigerating compartment. A plurality of air-directing guide vanes is positioned within the air tower and proximate a top of the air channel. The air-directing guide vanes direct the cooled air from the air channel to define redirected air that is delivered in a direction toward an upper cool-air slot defined within the air tower. The redirected air from the air-directing guide vanes travels through the upper cool-air slot at substantially the same velocity as the cooled air entering the air-directing guide vanes. The redirected air is directed through the upper cool-air slot and toward at least one upper corner of the refrigerating compartment.

In at least another aspect, an air tower for a refrigerating appliance includes a front panel and a rear panel that define an air channel therebetween. A plurality of cool-air slots are defined within the front panel, each of the cool-air slots being in communication with the air channel. A plurality of air-directing guide vanes are positioned proximate an upper portion of the air channel and upstream of an upper cool-air slot. The plurality of air-directing guide vanes and the upper cool-air slot define a laminar flow of redirected air that is expelled from the upper cool-air slot.

In at least another aspect, a refrigerating appliance includes an air tower having an air channel and a fan for delivering air through the air channel. A plurality of cool-air slots are disposed within the air tower, wherein the plurality of cool-air slots place the air channel in thermal communication with a refrigerating compartment. A plurality of air-directing guide vanes is positioned within a top portion of the air channel. The plurality of air-directing guide vanes direct air from within the air channel to define redirected air that is delivered in a direction toward an upper cool-air slot of the plurality of cool-air slots. The redirected air from the air-directing guide vanes travels through the upper cool-air slot in a laminar flow path and at substantially the same velocity as the air entering the air-directing guide vanes. The redirected air is directed through the upper cool-air slot and toward at least one upper corner of the refrigerating compartment.

These and other features, advantages, and objects of the present device will be further understood and appreciated by those skilled in the art upon studying the following specification, claims, and appended drawings.

BRIEF DESCRIPTION OF THE DRAWINGS

The patent or application file contains at least one drawing executed in color. Copies of this patent or patent application publication with color drawings will be provided by the Office upon request and payment of the necessary fee.

In the drawings.

DETAILED DESCRIPTION OF EMBODIMENTS

Figure 1:
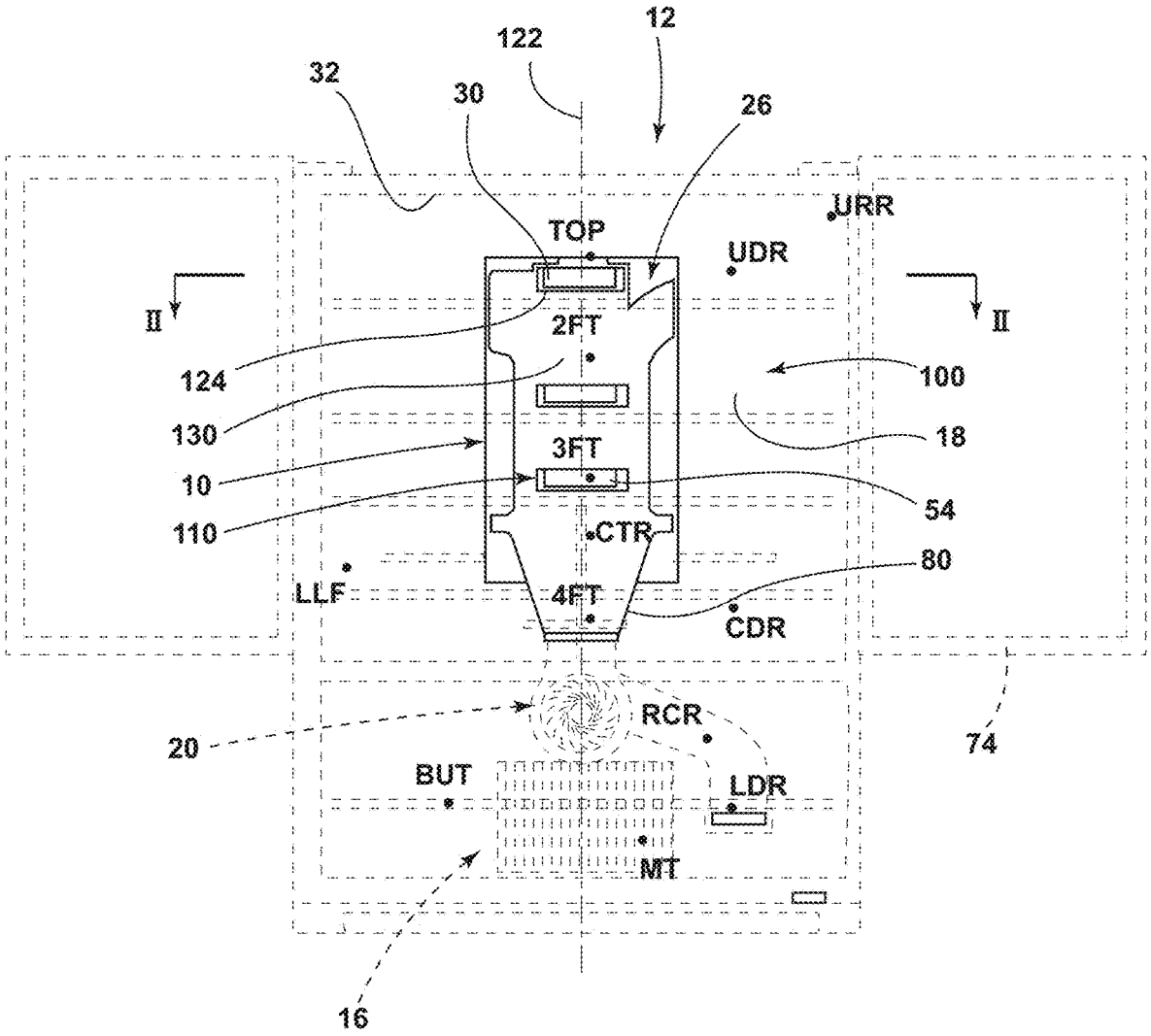
FIG. 1 is a schematic elevational view of a refrigerating appliance illustrating the position of the evaporator and the air tower within the appliance.
Figure 2:
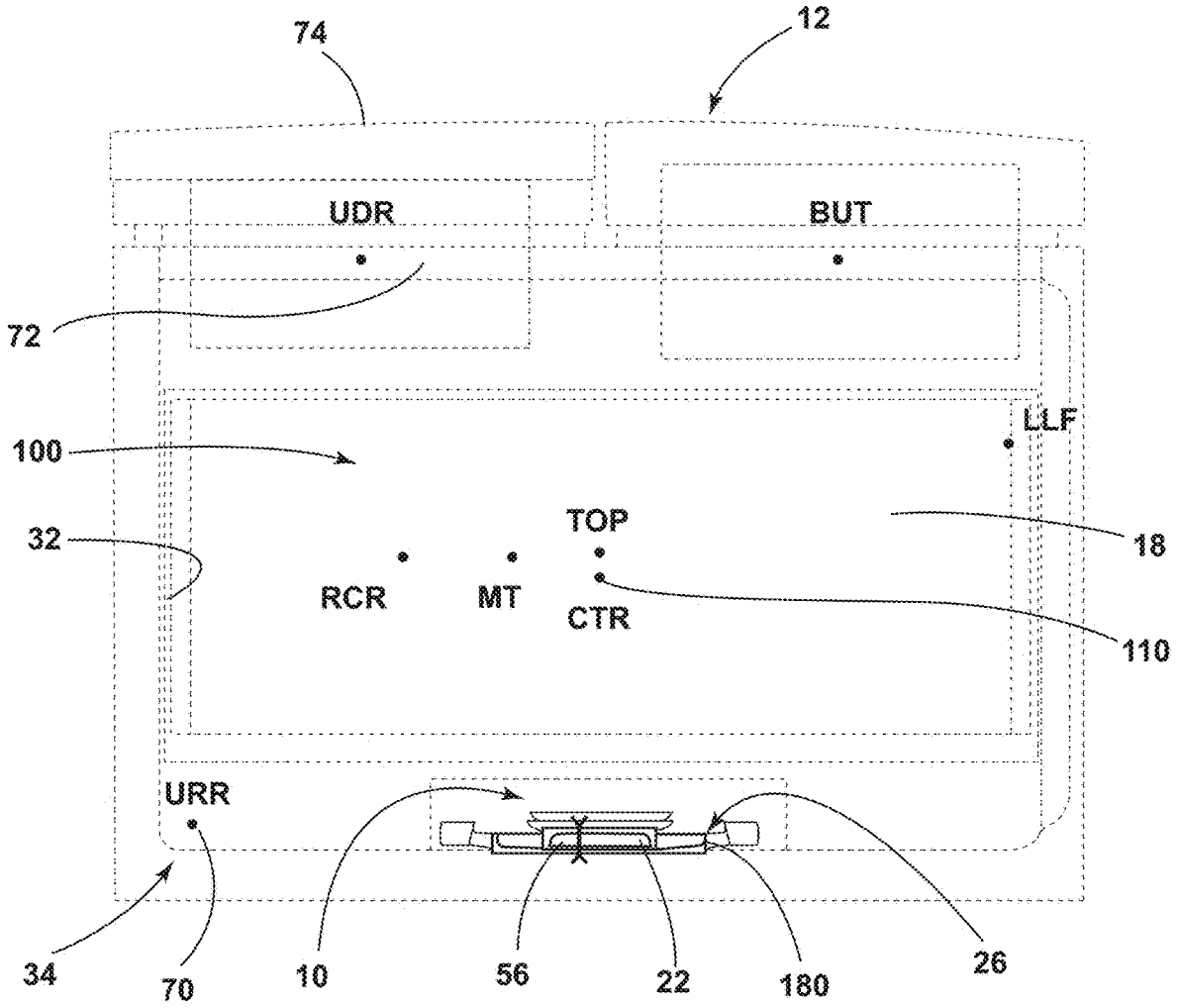
FIG. 2 is a cross-sectional view of the refrigerating appliance of FIG. 1 taken along line II-II.
Figure 3:
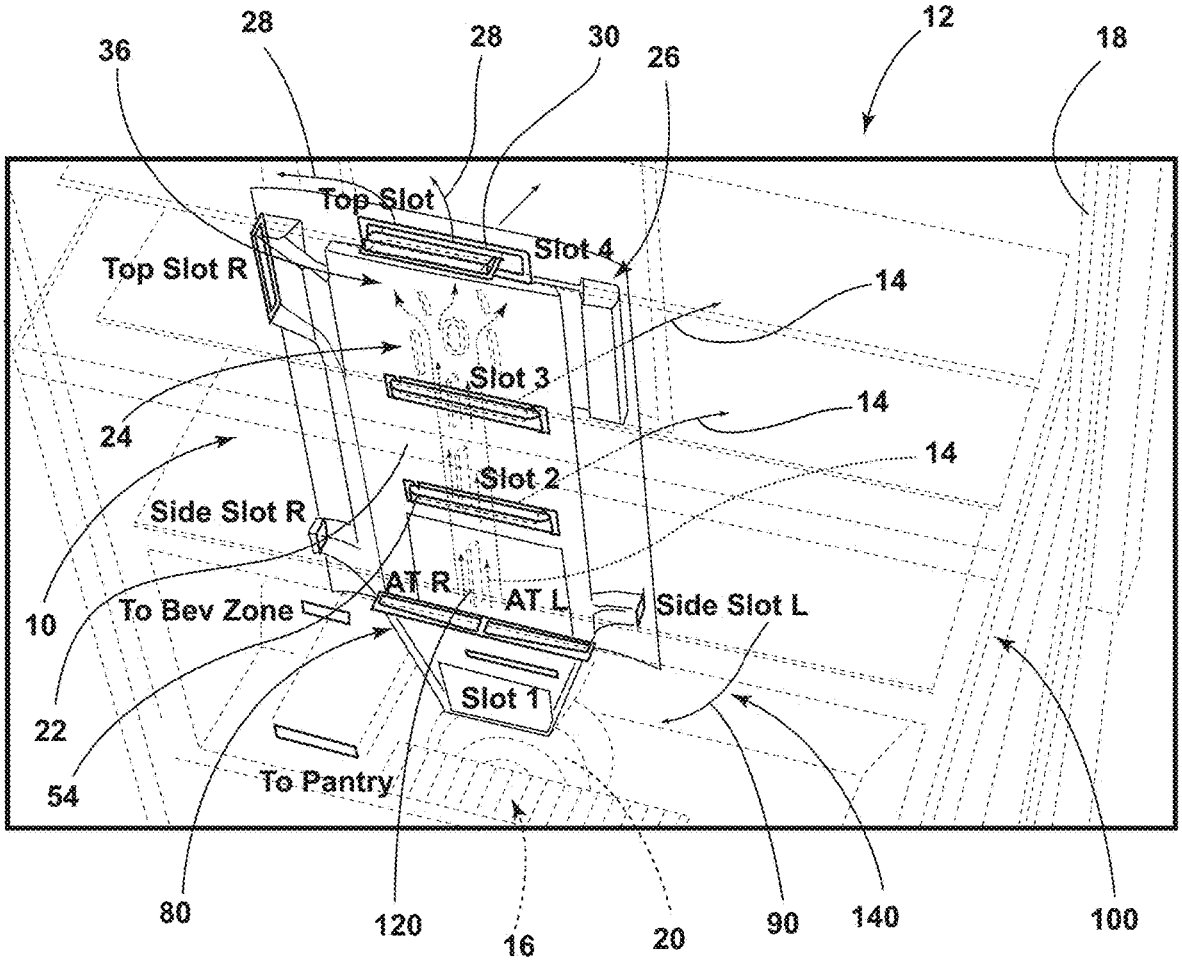
FIG. 3 is a schematic rear perspective view of the appliance of FIG. 1.
Figure 4:
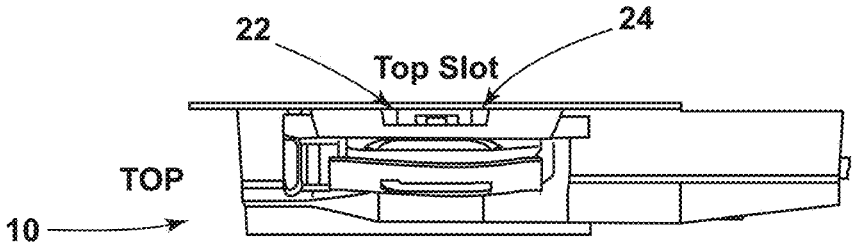
FIG. 4 is a partial top plan view of an aspect of an air tower for a refrigerating appliance.
Figure 5:
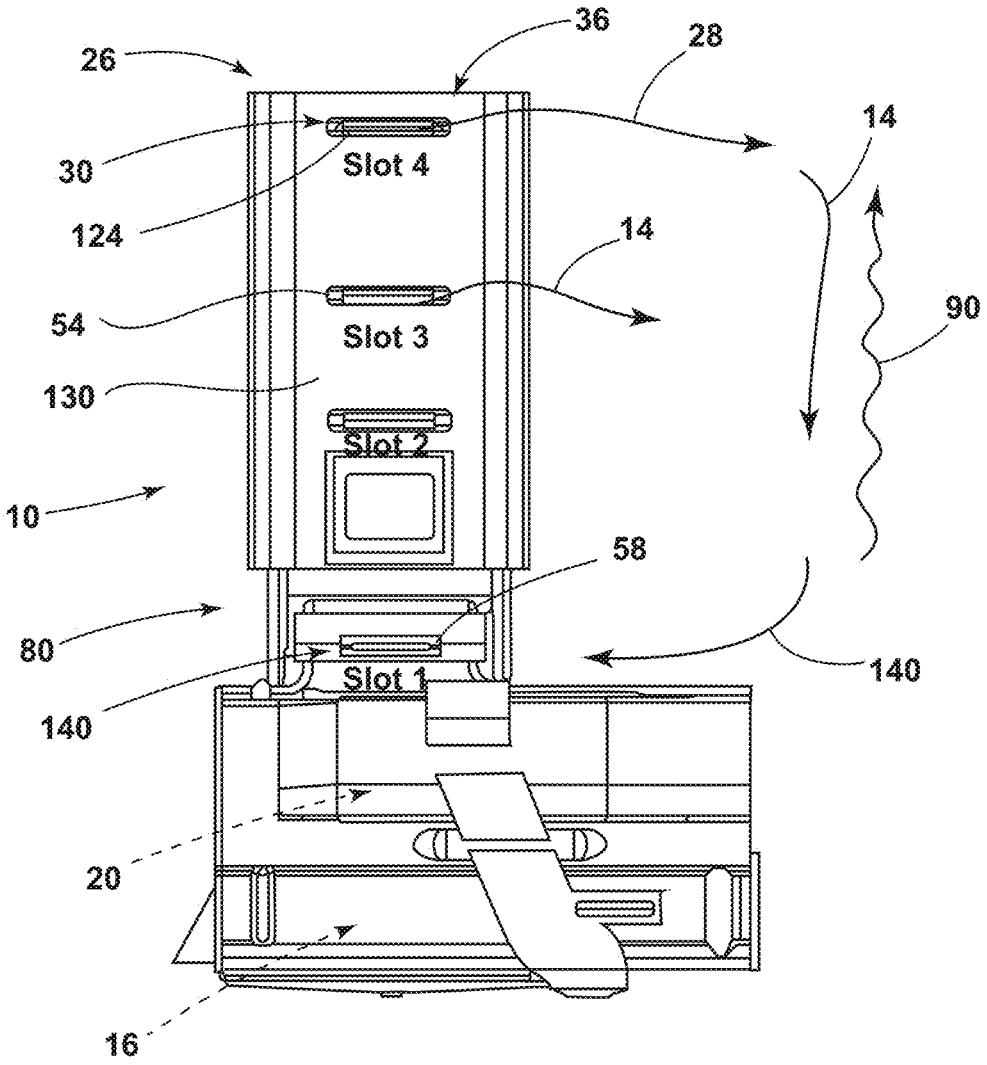
FIG. 5 is a front elevational view of the air tower of FIG. 4.
Figure 6:
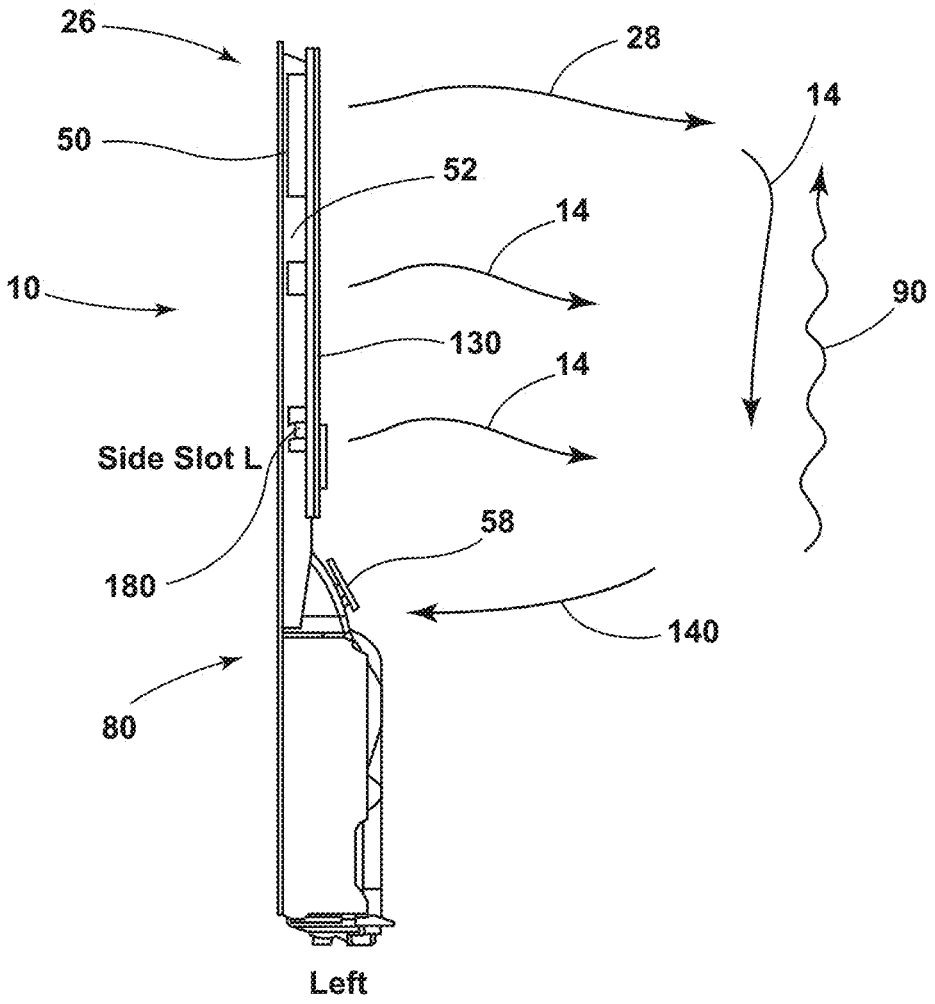
FIG. 6 is a first side elevational view of the air tower of FIG. 5.
Figure 7:
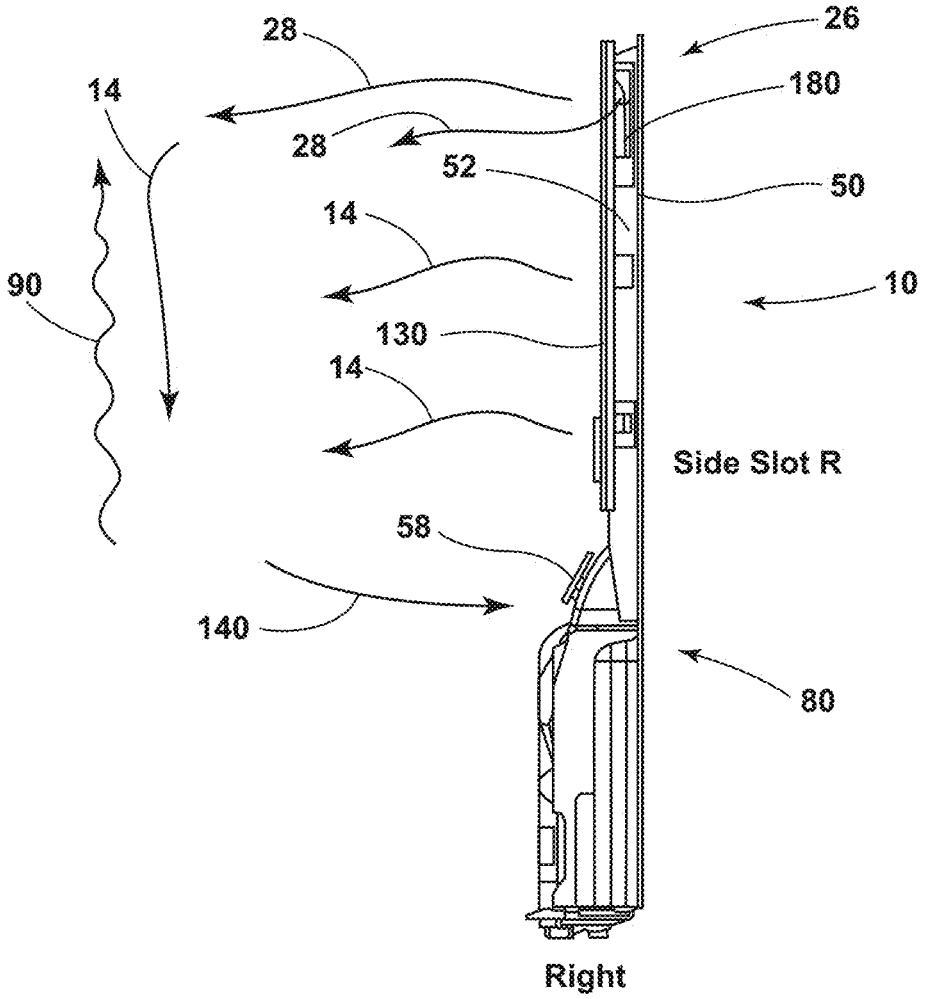
FIG. 7 is a second side elevational view of the air tower of FIG. 5.
Figure 8:
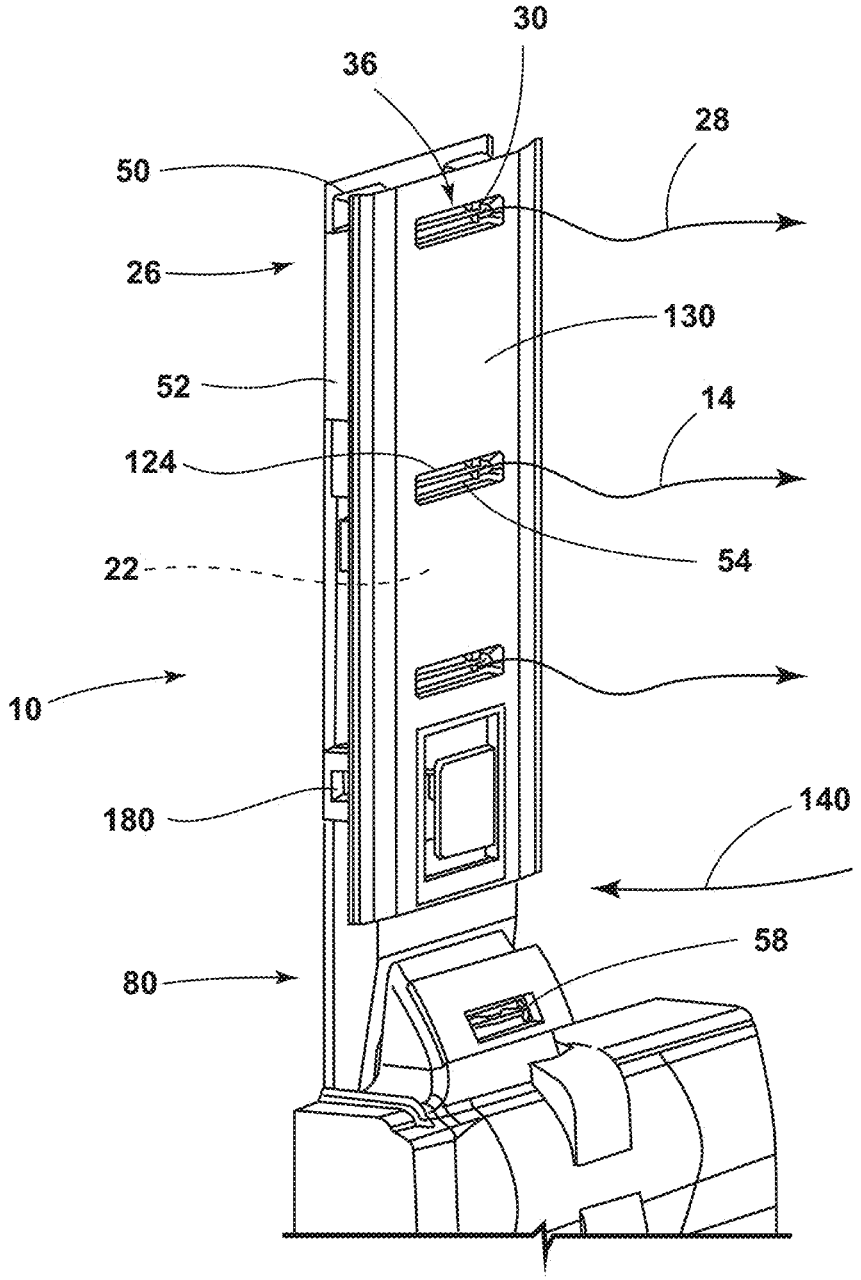
FIG. 8 is a side perspective view of the air tower of FIG. 5.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As illustrated in FIGS. 1-10, reference numeral 10 generally refers to an air tower disposed within an appliance 12 that is adapted to deliver cooled air 14 from the evaporator 16 for the appliance 12 to one or more cooled compartments, such as a refrigerating compartment 18, defined within the appliance 12. According to the various aspects of the device, the refrigerating appliance 12 can include the evaporator 16 that, along with a fan 20, provides the cooled air 14 to the refrigerating compartment 18, a freezing compartment, pantry compartment, or other similar compartment defined within the appliance 12. The air tower 10 for the appliance 12 defines an air channel 22 for directing the cooled air 14 from the evaporator 16 to at least the refrigerating compartment 18. A plurality of air-directing guide vanes 24 is positioned within the air tower 10 and proximate a top portion 26 of the air channel 22. According to various aspects of the device, the air-directing guide vanes 24 direct the cooled air 14 from the air channel 22 to define redirected air 28 that is delivered in a generally laminar flow path and in a direction toward an upper cool-air slot 30 defined within the air tower 10. The redirected air 28 from the air-directing guide vanes 24 travels through the upper cool-air slot 30 at substantially the same velocity magnitude as the cooled air 14 entering the air-directing guide vanes 24. Stated another way, as the cooled air 14 travels through the air-directing guide vanes 24, the cooled air 14 maintains substantially the same velocity magnitude after traveling through the guide vanes 24 and becoming redirected air 28 for traveling through the upper cool-air slot 30. The redirected air 28 is directed through the upper cool-air slot 30 and toward at least a portion of the upper perimeter 32 of the refrigerating compartment 18, such as at least one upper corner 34 of the refrigerating compartment 18. In this manner, the air-directing guide vanes 24 and the upper cool-air slot 30 cooperatively define a guided flow 36 of the redirected air 28 to at least a portion of the upper perimeter 32 of the refrigerating compartment 18.

In the various aspects of the device, the guided flow 36 of the redirected air 28 can take the form of various ranges of Reynolds number (Re) values, which describes the characteristic state of the fluid or an air stream. This guided flow 36 can be laminar, transitional, turbulent, or can exist in any one or more of these conditions for a wide range of operating parameters to distribute the redirected air 28 to desired areas. The range of laminar, transitional and turbulent characteristics of the guided flow 36 may vary depending on various factors that can include, but are not limited to, the speed of the fan 20, the temperature of the cooled air 14, the temperature of the redirected air 28, the positioning of the guide vanes 24, combinations thereof and other similar factors.

Referring again to FIGS. 1-10, the air tower 10 for the appliance 12 can include a rear panel 50 and a front panel 52. The air channel 22 is defined between the rear and front panels 50, 52 and extends through the air tower 10 for delivering the cooled air 14 from the evaporator 16 through the various slots 54 defined within the air tower 10. The air-directing guide vanes 24 are disposed within the top portion 26 of the air channel 22 and extend the full depth 56 between the rear panel 50 and the front panel 52. Accordingly, the guide vanes 24 extend the full depth 56 of the air channel 22. It is contemplated that the guide vanes 24 can be integrally formed with the rear panel 50, or can be integrally formed with the front panel 52. In this manner, when the front and rear panels 52, 50 are engaged together, the guide vanes 24 are disposed through the entire air channel 22 for deflecting the cooled air 14 to define redirected air 28 that is moved in a path of guided flow 36 through at least the upper cool-air slot 30 of the air tower 10.

Referring again to FIGS. 1-10, typical locations within a refrigerating compartment 18 that may become warmer faster than other portions of the refrigerating compartment 18 can include the upper right rear corner 70 that is disposed within a back corner to the right side of the refrigerating compartment 18 and also the upper door right corner 72 which is the upper front corner on the right side of the refrigerating compartment 18 near the door panel 74 that accesses the right side of the refrigerating compartment 18. In particular, French door bottom mount (FDBM) refrigerators experience this warming phenomena in these areas. The use of the guided flow 36 of redirected air 28 from the lower portions 80 of the air channel 22, through guide channels 82 defined between the guide vanes 24, and then through one or more upper slots 54, serves to project the redirected air 28 from the air tower 10 at a higher velocity, so that the cooled redirected air 28 can reach at least the upper right rear corner 70 and upper door right corner 72 within the refrigerating compartment 18. This guided flow 36 of redirected air 28 allows for lower temperature air to be directed to these upper corners 34.

Referring again to FIGS. 1-10, this configuration of the guide vanes 24 within the air tower 10 also serves to minimize the effect of heated air 90 that tends to rise within the refrigerating compartment 18 and toward the upper perimeter 32 of the refrigerating compartment 18. Additionally, by directing the cooled redirected air 28 toward the upper perimeter 32 of the refrigerating compartment 18, the cooled redirected air 28 will tend to travel in a generally downward direction as the generally warmer air tends to move in a generally upward direction. This upward and downward movement of heated and cooled air 90, 14, respectively, can serve to generally equalize the temperature in a consistent manner throughout the entire refrigerating compartment 18. In this manner, the guide vanes 24 in generating the guided flow 36 can minimize the presence of warmer areas and also excessively cool areas within the refrigerating compartment 18. Accordingly, the various lots 54 place the air channel 22 in thermal communication with the refrigerating compartment 18.

Additionally, while the upper right rear corner 70 and upper door right corner 72 are named above, the guide vanes 24 can be used to deliver the cooled redirected air 28 in a guided flow 36 to each of the upper corners 34 of the refrigerating compartment 18. This guided flow 36 generated by the guide vanes 24 can also serve to direct cooled redirected air 28 toward a substantial portion of the upper perimeter 32 of the refrigerating compartment 18 to provide greater consistency of temperature throughout the interior volume 100 of refrigerating compartment 18.

The positioning of the guide vanes 24 serves to solve problems of temperature disparity within the upper corners 34 and the upper perimeter 32 of the refrigerating compartment 18 relative to the temperature at the center 110, or along the central axis 122, of the refrigerating compartment 18. The guide vanes 24 are disposed within the air tower 10 to provide the guided flow 36 of redirected air 28. The guide vanes 24 serve to at least maintain, and also redistribute, the velocity profile of the redirected air 28 that exits the upper cool-air slot 30 defined within the air tower 10. By distributing the velocity profile, the redirected air 28 can define various individual streams of the redirected air 28, each having independent velocity magnitudes, for delivering the redirected air 28 to various portions of the upper perimeter 32 of the refrigerating compartment 18. In distributing the velocity profile, the velocity magnitude of the cooled air 14 entering the guide vanes 24 is redistributed via the guide channels 82. The redistribution of the velocity profile results in the individual air streams of redirected air 28, where some of the air streams may have a greater velocity magnitude and, as a tradeoff, other air streams will have a decreased velocity magnitude. The design of the guide vanes 24 utilizes the momentum of the cooled air 14 leaving the fan 20 and takes advantage of the increases and tradeoffs in velocity magnitude to distribute the redirected air 28 as desired to achieve consistent temperatures throughout the refrigerating compartment 18. These air streams having ranges of locally increased and locally decreased velocity magnitudes are also directed by the guide vanes 24 to deliver the redirected air 28 to the desired portions of the upper perimeter 32 of the refrigerating compartment 18. In this manner, the momentum of the cooled air 14 leaving the fan 20 is maintained as the cooled air 14 enters and passes through the guide channels 82 to define the various air streams of redirected air 28 having increased and decreased velocity magnitudes. This utilization of momentum also results in the guided flow 36 of redirected air 28 not breaking apart, separating, or incurring a significant loss of energy.

Referring again to FIGS. 1-10, the guide vanes 24 are disposed within the air tower 10 behind the front panel 52, such that they are not visible or accessible to the customer. Additionally, the configuration of the guide vanes 24 in creating the guided flow 36 path of redirected air 28 does not create any significant losses in the flow of energy throughout the refrigerating compartment 18.

Referring now to FIGS. 4-10, the air tower 10 for the appliance 12 includes a vertical channel in the form of the air channel 22 that includes insulation to minimize the risk of condensation in and around the air tower 10. Structural supports 120 are included along a vertically oriented central axis 122 of the air channel 22 to minimize the risk of crushing of the air tower 10 during manufacture and use of the appliance 12. The various slots 54 and other apertures 124 that open into the refrigerating compartment 18 are defined within the air tower 10 and allow the cooled air 14 from the air tower 10 as well as the redirected air 28 from the guide vanes 24 to enter the refrigerating compartment 18. Accordingly, the various slots 54 place the air channel 22 in thermal communication with the refrigerating compartment 18

In various embodiments, a cover member 130 is included over the front panel 52 of the air tower 10 for decoration. Where the cover member 130 is included, various apertures 124 can be defined within the front panel 52 as well as the cover member 130 to allow for movement of the air from the air tower 10 and throughout the refrigerating compartment 18.

During operation of the appliance 12, air, cooled air 14, redirected air 28, and heated air 90 are moved through the refrigerating compartment 18 and are ultimately collected along the bottom of the refrigerating compartment 18 through a return slot 58. The return air 140 that passes through the return slot 58 is typically heated air 90 that is warmed within the refrigerating compartment 18 environment by gathering heat energy from various items within the refrigerating compartment 18 needing to be cooled. The return air 140 has substantial momentum to pass through a relatively cold evaporator 16, which removes heat from the flow of air via conductive metal fins and refrigerant tubing. After passing through the evaporator 16, the return air 140 defines cooled air 14 that is then moved back into the air tower 10. The momentum that accelerated the return air 140 through the evaporator 16 is then drawn into a fan 20 to be ejected in a generally vertical direction into the air tower 10. Changing the temperature of the evaporator 16 will have a corresponding change in the temperature of the cooled air 14 moving through the air tower 10 and then into the refrigerating compartment 18 such that various temperature modifications can be made during use of the appliance 12.

As discussed above, the upper corners 34 and upper perimeter 32 of the refrigerating compartment 18 are particularly challenging locations within the refrigerating compartment 18 to cool. These areas are typically closest to warm air outside the unit and the upper portion of the refrigerator cabinet is susceptible to natural convection of the flow of air within the refrigerating compartment 18. As discussed previously, the heated air 90 within the refrigerating compartment 18 tends to rise and the cooled air 14 and redirected air 28 from the air tower 10 tends to fall. Accordingly, sections within the refrigerating compartment 18 near the top surface of the cabinet tend to be naturally warmer. The configuration of the guide vanes 24 for generating the guided flow 36 of redirected air 28 provides greater velocity of air leaving the air tower 10 such that this higher velocity of redirected air 28 can be moved toward the upper corners 34 and the upper perimeter 32 of the refrigerating compartment 18. This configuration tends to counteract the natural tendency of these upper portions of the refrigerated cabinet to be generally warmer. The result is a greater temperature consistency throughout the refrigerating compartment 18. This consistency is accomplished while not detecting from the aesthetics of the appliance 12. Again, the guide vanes 24 are concealed from view within the air tower 10.

Figure 9:
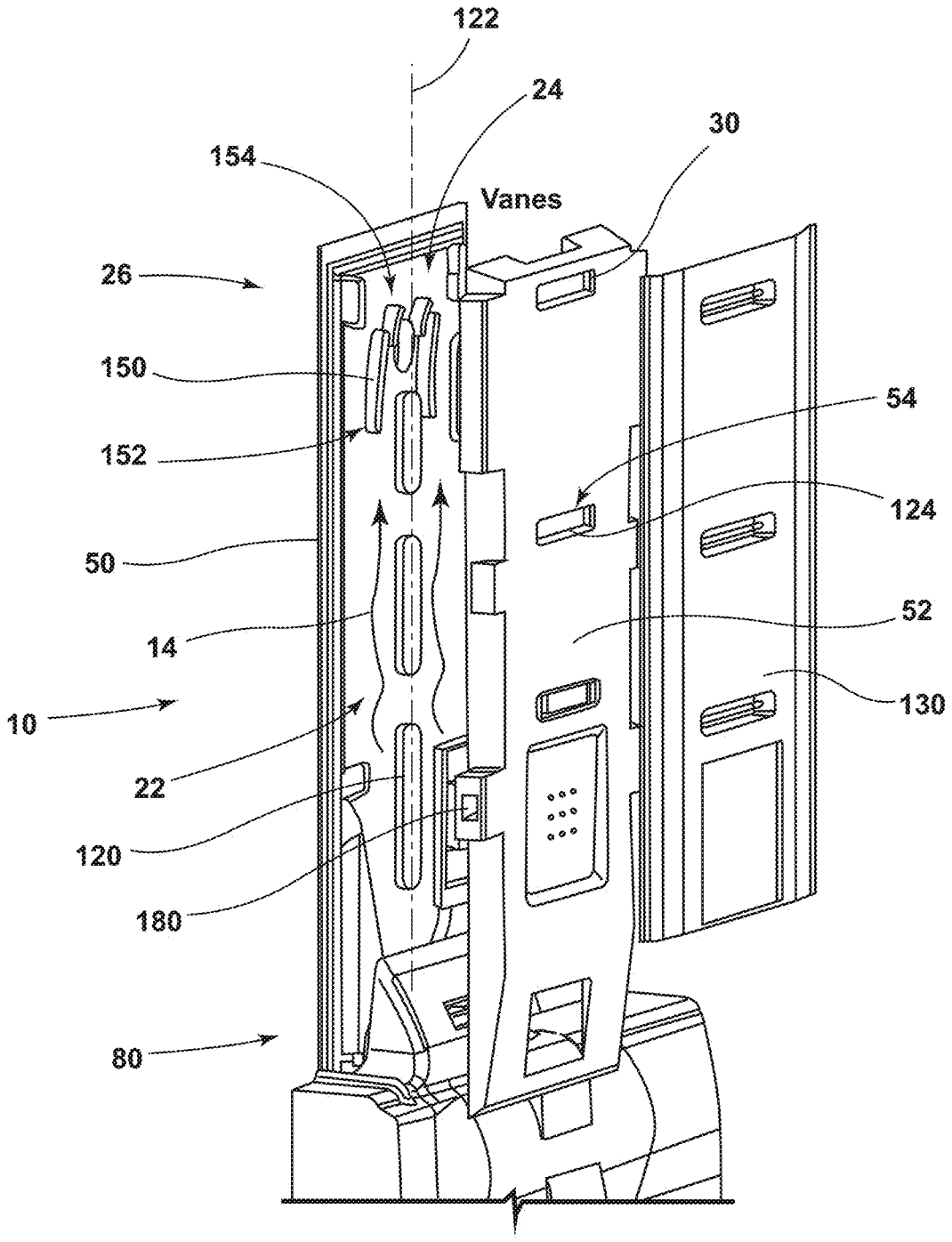
FIG. 9 is an exploded perspective view of the air tower of FIG. 8.
Figure 10:
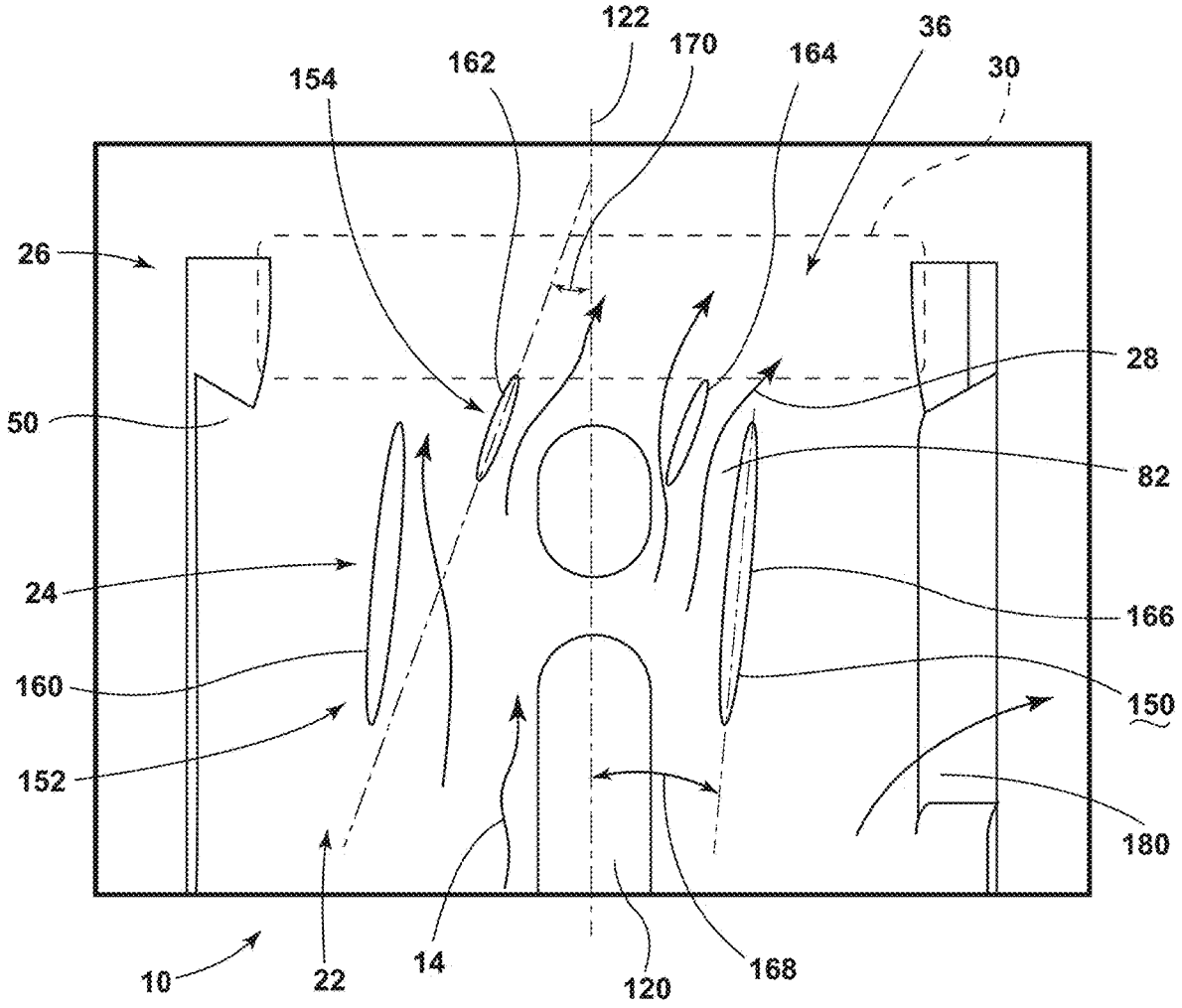
FIG. 10 is a front elevational view of an aspect of the configuration of the guide vanes disposed within the air tower.

Referring now to FIGS. 9 and 10, the guide vanes 24 included within the air tower 10 include a plurality of guide vanes 24 that are set at various angles for directing the guided flow 36 of redirected air 28 in the general direction of the upper cool-air slot 30. In this manner, as the cooled air 14 from the fan 20 is directed upward through the air tower 10, the cooled air 14 moves through the guide channels 82 defined between the guide vanes 24 and is redirected in the general direction of an aperture 124 of one or more of the slots 54 defined within the air tower 10. By redirecting the cooled air 14 in the direction of the aperture 124 of one or more of the slots 54, the now redirected air 28 moving through the slots 54 can maintain a substantially consistent velocity. This velocity can be maintained because the air moving through the slot 54 does not undergo an additional significant redirection or experience significant unwanted flow effects that might slow the velocity of the redirected air 28 as it moves toward the upper corners 34 and/or upper perimeter 32 of the refrigerating compartment 18. Accordingly, the primary air redirection feature of the air tower 10 is in the form of the guide vanes 24 that are concealed within the air tower 10 which minimize unwanted turbulence and adverse pressure gradients experienced by the redirected air 28 and also generally direct the redirected air 28 toward the upper perimeter 32 of the refrigerating compartment 18.

It is contemplated that the guide vanes 24 can take any one of various shapes and configurations that may vary depending upon the exact configuration of the particular appliance 12 in which the guide vanes 24 are disposed. Various factors that may affect the exact configuration of the guide vanes 24 can include, but are not limited to, appliance size, compartment size, cooled temperature range, compartment depth 56, the amount of air able to be moved within the appliance 12, the configuration of the compartments within the appliance 12, the material of the guide vanes 24, the surface texture of the guide vanes 24 and other similar considerations.

Referring again to FIGS. 9-12, an exemplary configuration of the guide vanes 24 is disclosed herein. While this particular configuration has been tested and has been shown to provide favorable results, as discussed above, the exact configuration of the appliance 12 may be subject to slight alterations to this exemplary configuration of the guide vanes 24.

As exemplified in FIGS. 9 and 10, the guide vanes 24 can include an arcuate outer surface 150 that is free of corners. In an exemplary embodiment, the guide vanes 24 can be substantially elliptical in configuration, such that the outer surface 150 of each guide vane 24 is substantially free of any corners and defines a substantially smooth outer surface 150. The plurality of guide vanes 24 define a corresponding plurality of guide channels 82 that receive the cool air from the air channel 22 and define the redirected air 28 as the cooled air 14 moves through the guide channels 82 and is redirected by the guide vanes 24. To form the redirected air 28 for moving through the upper cool-air slot 30 in a substantially guided flow 36 and toward the portions of the upper perimeter 32 of the refrigerating compartment 18, the plurality of guide vanes 24 can include two outer elongated guide vanes 152 and two inner truncated guide vanes 154.

Referring again to FIGS. 9 and 10, spaces between the first elongated guide vane 160 and the first truncated guide vane 162, the space between the first and second truncated guide vanes 162, 164 and the space between the second truncated guide vane 164 and the second elongated guide vane 166 can each define separate guide channels 82 for producing the guided flow 36 of redirected air 28. Additionally, the first and second elongated guide vanes 160, 166 are each outwardly positioned at a first angle 168 with respect to a central axis 122 of the air channel 22. The first and second truncated guide vanes 162, 164 are inwardly positioned at a second angle 170 with respect to the central axis 122. While the first and second angles 168, 170 may vary, in the exemplified configuration, the second angle 170 is greater than the first angle 168, such that the first and second truncated guide vanes 162, 164 are positioned at a greater angle with respect to the central axis 122 of the air tower 10. Significantly, the elongated guide vanes 152 and the truncated guide vanes 154 are each positioned in a staggered configuration. As discussed above, the guide vanes 24 extend the depth 56 of the air tower 10 to occupy the entirety of the air channel 22. The elongated guide vanes 152 are positioned upstream of the upper cool-air slot 30. The truncated guide vanes 154 are positioned downstream of the elongated guide vanes 152 but are upstream of the upper cool-air slot 30 defined within the front panel 52 of the air tower 10. The staggered arrangement of the guide vanes 24 utilizes various aerodynamic principles that minimize energy loss of the airstream. This staggered configuration serves to minimize adverse flow effects and allows for smoother laminar flow of the redirected air 28 through the guide vanes 24. The attachment of the flow of the guide vanes 24 through the staggered elongated and truncated guide vanes 154 encourages a continuous smooth and laminar turning or redirection of the cooled air 14 within the air tower 10 to define the redirected air 28. Stated another way, the configuration of the guide vanes 24 ensures that the guided flow 36 of redirected air 28 is in the direction of the upper perimeter 32 as the redirected air 28 passes through the upper cool-air slot 30.

Referring again to FIGS. 1-10, in addition to providing a guided flow 36 of the redirected air 28 to the upper cool-air slot 30, the guide vanes 24 can be used to define a guided flow 36 of redirected air 28 to other slots 54 located within the top portion 26 of the air tower 10. It is contemplated that the guide vanes 24 can be used to direct a guided flow 36 of air toward side apertures 180 in addition to the aperture 124 of the upper cool-air slot 30 of the air tower 10. These additional apertures 124 through which the guided flow 36 can be directed can be defined within the front panel 52 or can be defined within a side of the air tower 10 between the front and rear panels 52, 50.

Figures 13, 14:
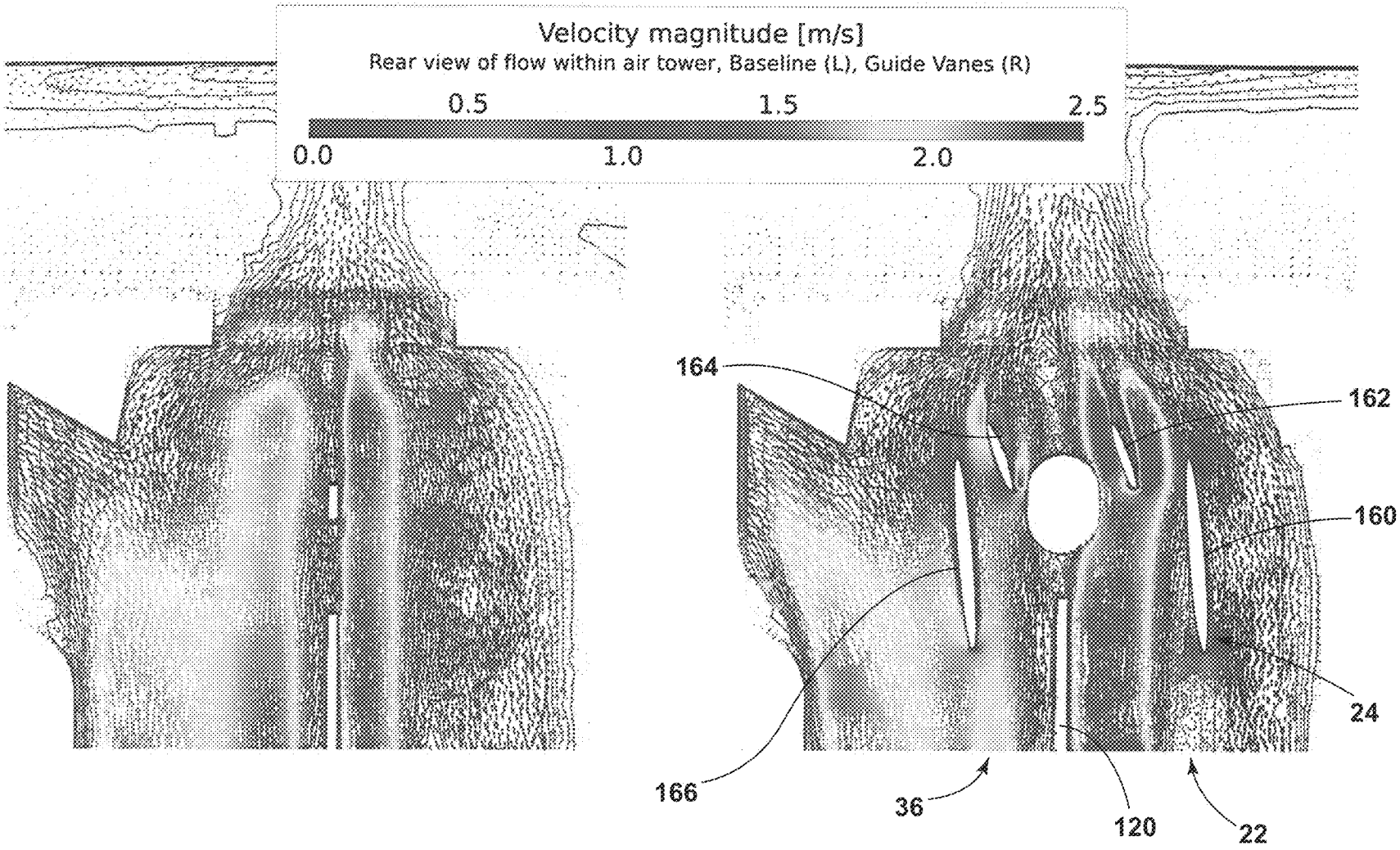
FIG. 13 (PRIOR ART)
FIG. 13 is a prior art schematic diagram illustrating the velocity magnitude taken from the rear of the air channel and representing an air-flow condition during operation of the appliance through a prior art air channel having no guide vanes.
FIG. 14 is a schematic diagram illustrating the velocity magnitude taken from the rear of the air channel and representing an air-flow condition during operation of the appliance through an air channel having an exemplary configuration of guide vanes.
Figure 15:
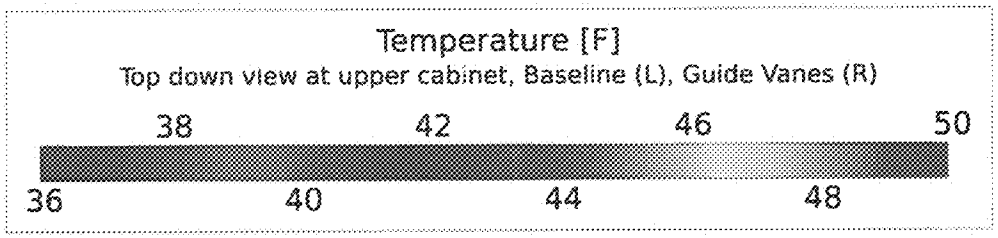
FIG. 15 (PRIOR ART)
FIG. 15 is a prior art schematic diagram illustrating the refrigerating compartment temperature taken from a top of the refrigerated cabinet and representing an air-flow condition during operation of the appliance through a prior art air channel having no guide vanes.
Figure 15:
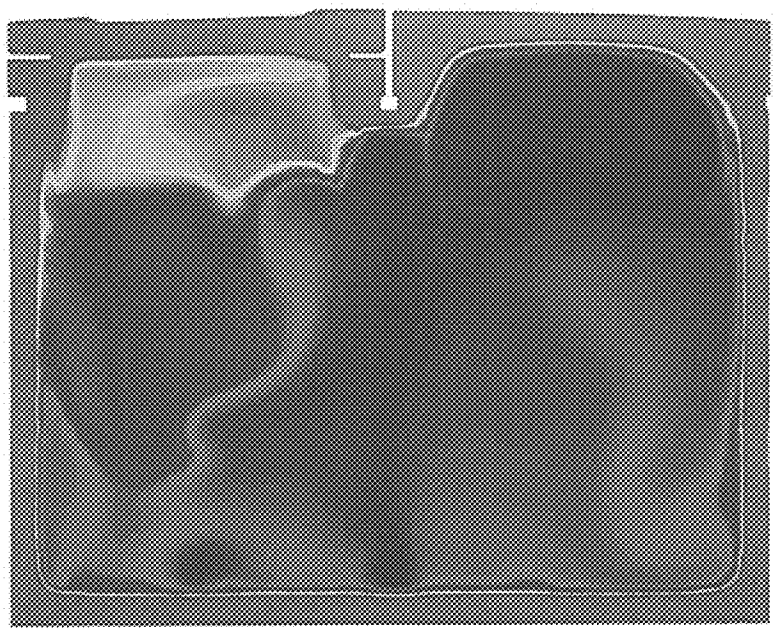
FIG. 15 (PRIOR ART)
Figure 16:
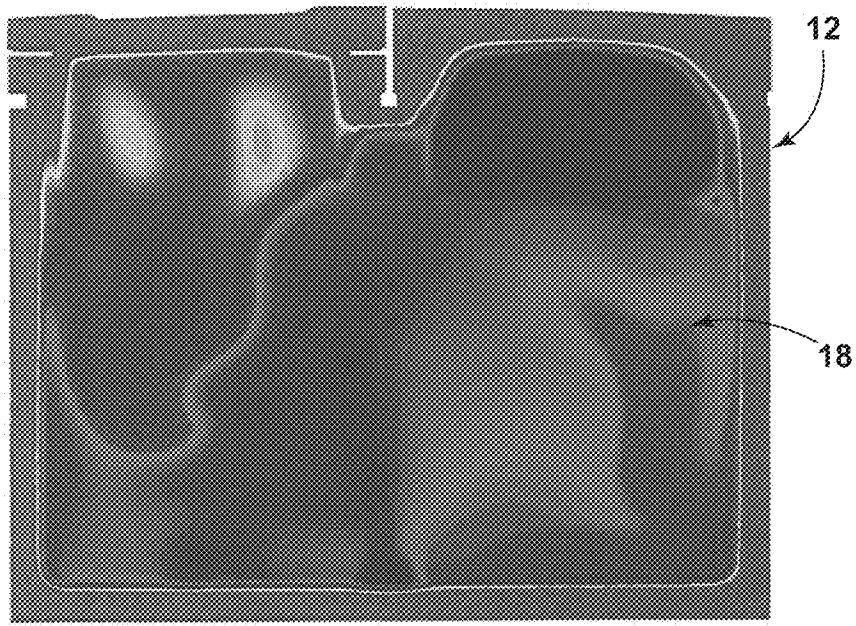
FIG. 16 is a schematic diagram illustrating the refrigerating compartment temperature taken from a top of the refrigerated cabinet and representing an air-flow condition during operation of the appliance through a prior art air channel having an exemplary configuration of guide vanes.
Figures 17, 18:
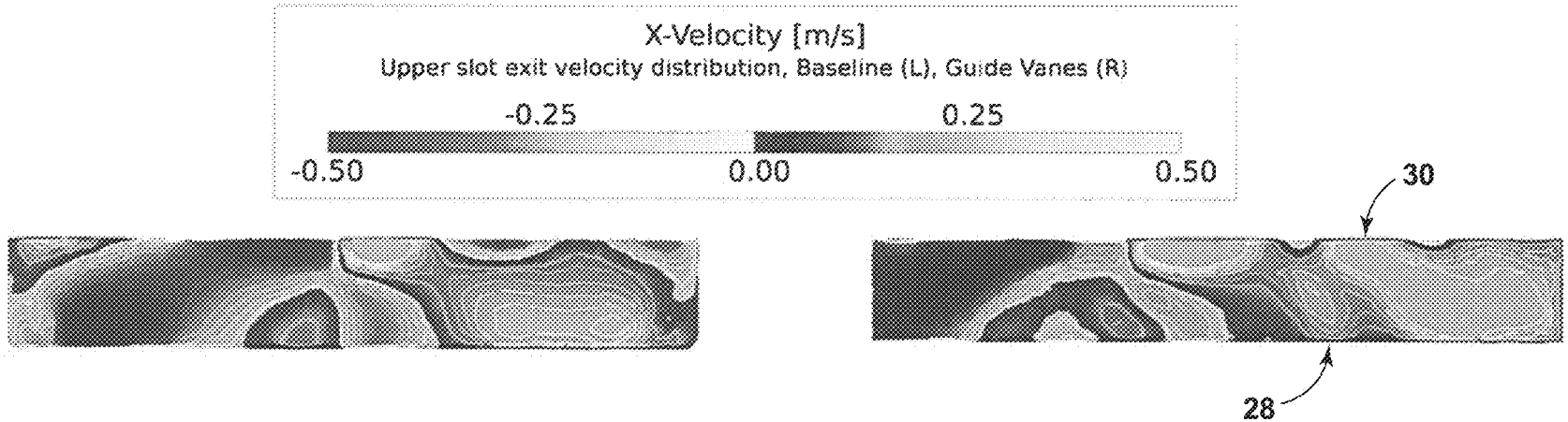
FIG. 17 (PRIOR ART)
FIG. 17 is a prior art schematic diagram illustrating the velocity magnitude taken at the upper cool-air slot and representing an air-flow condition during operation of the appliance through a prior art air channel having no guide vanes.
FIG. 18 is a schematic diagram illustrating the velocity magnitude taken at the upper cool-air slot and representing an air-flow condition during operation of the appliance through an air channel having an exemplary configuration of guide vanes.

Referring now to FIGS. 13-18, a set of comparative schematic diagrams are disclosed that represent operation of a prior art air handling tower (FIGS. 13, 15 and 17) in comparison to the exemplary configuration of an aspect of the air tower 10 having guide vanes 24 as disclosed herein (FIGS. 14, 16 and 18).

As exemplified in FIGS. 13, 15 and 17, the prior art appliance results in pockets of quickly moving air and pockets of more stagnant air that persist adjacent to one another, but do not mix in a significant manner. In this prior art device, these pockets of diverse velocities that do not mix can result in disparities in temperature and can reflect areas of air that are too cold or are too warm within the prior art appliance. In particular, the areas in the center of the prior art appliance are exceedingly cold and areas near the perimeter of the compartment are warmer. This lack of mixing in the prior art appliance is reflected in an air channel that includes a single air stream of high velocity air that is directed through an opening of the air tower.

When compared against the novel design exemplified in FIGS. 14, 16 and 18, the guide vanes 24 generate air streams of redirected air 28 having ranges of locally increased and locally decreased velocity magnitudes that are directed by the guide vanes 24 to deliver the redirected air 28 to the desired portions of the upper perimeter 32 of the refrigerating compartment 18. The result is a more evenly dispersed temperature throughout the refrigerating compartment 18. As an example, the center 110 of the refrigerating compartment 18 has a temperature that is less extreme than that of the prior art design. Rather, the areas of the refrigerating compartment 18 near the upper perimeter 32 are cooler as a result of the multiple air streams of redirected air 28 having locally increased and locally decreased velocity magnitudes.

According to various aspects of the device, the air tower 10 for the refrigerating appliance 12 can include the front panel 52 and the rear panel 50 that define the air channel 22 therebetween. A plurality of cool-air slots 30 are defined within the front panel 52, where each of the cool-air slots 30 is in communication with the air channel 22. A plurality of air-directing guide vanes 24 are positioned approximate an upper or top portion 26 of the air channel 22 and upstream of an upper cool-air slot 30. It is contemplated that the plurality of air-directing guide vanes 24 and the upper cool-air slot 30 define a guided flow 36 of redirected air 28 that is expelled from the upper cool-air slot 30. As discussed above, the redirected air 28, because of the minimal disruption of the flow or development of adverse and undesired flow conditions, can maintain a substantially high velocity with respect to the cooled air 14 within the air tower 10, such that at least some of the air streams of the redirected air 28 can reach portions of the upper perimeter 32 of the refrigerating compartment 18 such as the upper corners 34 of the refrigerating compartment 18.

Figure 11:
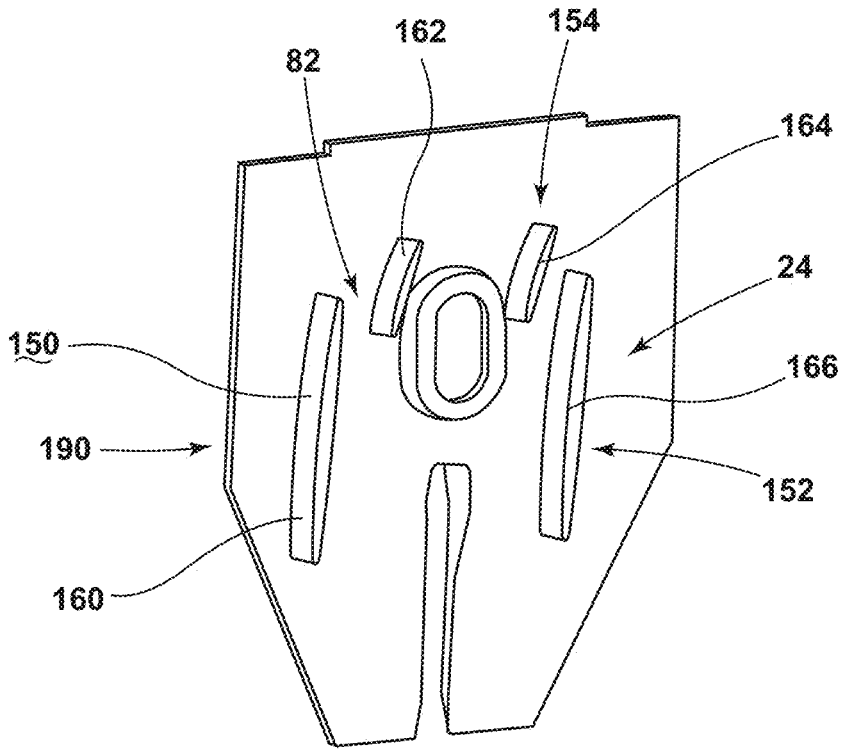
FIG. 11 is a front perspective view of an aspect of the guide vanes incorporated within a separate guide panel to be disposed within an air tower for an appliance.
Figure 12:
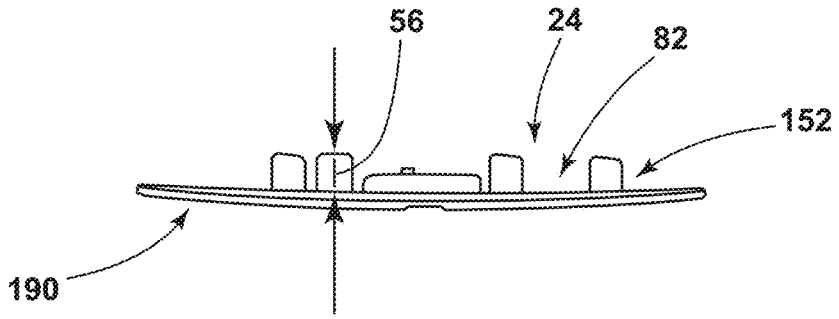
FIG. 12 is a top plan view of the guide panel of FIG. 11.

Referring now to FIGS. 11 and 12, it is contemplated that the guide vanes 24 can be disposed within a guide panel 190 that can be installed within an air tower 10 for an appliance 12. In such an embodiment, the guide vanes 24 can be formed as part of the guide panel 190. The guide panel 190 can then be installed during manufacture of the appliance 12 within the air tower 10, such that existing tooling for the air tower 10 and forming the front and rear panels 50 need not be generated. Additionally, the use of the guide panel 190 can allow for different configurations of guide vanes 24 that may be used within different designs of appliances 12. By way of example, and not limitation, the guide vanes 24 used within an FDBM refrigerator may be different than those guide vanes 24 used within a side-by-side refrigerating appliance 12. The use of the guide panel 190 may account for these variations within different models of appliances 12. Typically, it is contemplated that the guide vanes 24 will be integrally formed with either the front panel 52 or the rear panel 50 of the air tower 10.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A refrigerating appliance comprising:

an evaporator for providing cooled air to a refrigerating compartment;

an air tower defining an air channel for directing the cooled air from the evaporator to the refrigerating compartment; and a plurality of air-directing guide vanes positioned within the air tower and proximate a top of the air channel; wherein the air-directing guide vanes are substantially elliptical in configuration and direct the cooled air from the air channel to define redirected air that is delivered in a direction toward an upper cool-air slot defined within the air tower;

the redirected air from the air-directing guide vanes travels through the upper cool-air slot at substantially the same velocity as the cooled air entering the air-directing guide vanes; and the redirected air is directed through the upper cool-air slot and toward at least one upper corner of the refrigerating compartment.

2. The refrigerating appliance of claim 1, wherein the redirected air is redirected by each of the air-directing guide vanes and the upper cool-air slot to be directed to the at least one upper corner of the refrigerating compartment.

3. The refrigerating appliance of claim 2, wherein the air-directing guide vanes and the upper cool-air slot cooperatively define a laminar flow of the redirected air to the at least one upper corner of the refrigerating compartment.

4. The refrigerating appliance of claim 1, wherein the air tower includes a rear panel and a front panel, wherein the air channel is defined between the rear and front panels.

5. The refrigerating appliance of claim 4, wherein the air-directing guide vanes extend between the rear and front panels.

6. The refrigerating appliance of claim 1, wherein the air-directing guide vanes include two outer elongated guide vanes and two inner truncated guide vanes.

7. The refrigerating appliance of claim 1, wherein the air-directing guide vanes include an arcuate outer surface that is free of corners.

8. The refrigerating appliance of claim 1, wherein the air-directing guide vanes define a plurality of guide channels that receive the cooled air from the air channel and redirect the cooled air to define the redirected air.

9. The refrigerating appliance of claim 2, wherein the at least one upper corner includes a front right upper corner and a rear right upper corner of the refrigerating compartment.

10. The refrigerating appliance of claim 6, wherein the outer elongated guide vanes are positioned at a first angle with respect to a central axis of the air channel, and wherein the two inner truncated guide vanes are positioned at a second angle with respect to the central axis, wherein the second angle is greater than the first angle.

11. An air tower for a refrigerating appliance, the air tower comprising:

a front panel and a rear panel that define an air channel therebetween;

a plurality of cool-air slots that are defined within the front panel, each of the cool-air slots being in communication with the air channel; and a plurality of air-directing guide vanes that are positioned proximate an upper portion of the air channel and upstream of an upper cool-air slot, wherein the plurality of air-directing guide vanes and the upper cool-air slot define a laminar flow of redirected air that is expelled from the upper cool-air slot; wherein the air-directing guide vanes are integrally formed with the rear panel; and the air-directing guide vanes include two outer elongated guide vanes and two inner truncated guide vanes.

12. The air tower of claim 11, wherein the outer elongated guide vanes are positioned at a first angle with respect to a central axis of the air channel, and wherein the two inner truncated guide vanes are positioned at a second angle with respect to the central axis, wherein the second angle is greater than the first angle.

13. The air tower of claim 11, wherein the upper cool-air slot is defined within at least one of the front panel and a side of the air tower.

14. The air tower of claim 12, wherein each guide vane of the plurality of air-directing guide vanes include an arcuate outer surface that is free of corners.

15. A refrigerating appliance comprising:

an air tower having an air channel and a fan for delivering air through the air channel;

a plurality of cool-air slots that are disposed within the air tower, wherein the plurality of cool-air slots place the air channel in thermal communication with a refrigerating compartment; and a plurality of air-directing guide vanes positioned within a top portion of the air channel; wherein the plurality of air-directing guide vanes direct air from within the air channel to define redirected air that is delivered in a direction toward an upper cool-air slot of the plurality of cool-air slots;

the redirected air from the air-directing guide vanes travels through the upper cool-air slot in a laminar flow path and at substantially the same velocity as the air entering the air-directing guide vanes;

the redirected air is directed through the upper cool-air slot and toward at least one upper corner of the refrigerating compartment;

the air-directing guide vanes include two outer elongated guide vanes and two inner truncated guide vanes;

the outer elongated guide vanes are positioned at a first angle with respect to a central axis of the air channel; and the two inner truncated guide vanes are positioned at a second angle with respect to the central axis, where the second angel is greater than the first angle.

16. The refrigerating appliance of claim 15, wherein the air-directing guide vanes are substantially elliptical in configuration.

* * * * *